US006109390A

United States Patent [19]

Giannopoulos

[11] Patent Number: 6,109,390

[45] **Date of Patent: *Aug. 29, 2000**

[54] UNIVERSAL MOTORIZED SCAFFOLD TRUCK

[76] Inventor: Jerome Giannopoulos, P.O. Box 208, Chalk Hill, Pa. 15421-0208

[ * ] Notice: This patent issued on a continued prosecution application filed under 37 CFR 1.53(d), and is subject to the twenty year patent term provisions of 35 U.S.C. 154(a)(2).

[21] Appl. No.: 08/603,348

[22] Filed: Feb. 20, 1996

Related U.S. Application Data

[63] Continuation-in-part of application No. 08/494,923, Jun. 26, 1995, abandoned.

[51] Int. Cl.[7] ..... E04B 1/20

[52] U.S. Cl. ..... 182/16; 182/13

[58] Field of Search ..... 182/12–17

[56] References Cited

U.S. PATENT DOCUMENTS 1,736,501 11/1929 Macklem .
2,857,212 10/1958 Everitt ..... 182/17 X
3,503,466 3/1970 Rosander ..... 182/16 X
4,967,733 11/1990 Rousseau ..... 182/16 X

*Primary Examiner*—Alvin Chin-Shue
*Attorney, Agent, or Firm*—Carothers & Carothers

[57] ABSTRACT

A universal motorized scaffold truck with a horizontal support frame adapted for removably supporting scaffold or "A" ladders thereon and supported by wheels for lateral movement on a ground surface. A vertically extendable steering mast is provided which is secured at its lower end to the frame and adapted for steering selected of the wheels from the upper end of the mast. An electric motor is mounted on the frame and adapted for driving desired wheels and a switch is provided at the upper end of the mast for selectively engaging the electric motor to drive the truck in either direction. The steering mast is adapted to fold down horizontally for storage on the frame and may be locked into position in its upright position and secured to the scaffold or ladder for security.

10 Claims, 13 Drawing Sheets

UNIVERSAL MOTORIZED SCAFFOLD TRUCK

This compilation is intended as a continuation-in-part for application Ser. No. 08/494,923, filed on Jun. 6, 1995 abnd; which is held by Jerome Giannopoulos, requestor of this continuation-in-part.

SUMMARY OF THE INVENTION

It is an object of the invention to provide a motorized truck which allows complete and total adjustability to fit all manufactured sizes of scaffolds and "A" frame ladders, in which the sub-frame assembly remains fixed and the length and/or width of the scaffold truck support braces vary in length and collar type or position alternate so as to accept the differences in size.

A second object of the invention is to allow all four wheels to be locked from the top of the scaffold or ladder platform, in which the rear drive wheels lock automatically when the motor disengages and the front steering wheels remain fixed in place when the steering lever on the steering assembly is extended, lowered to parallel the steering masts, then pinned, locking the masts against the structure. This disallows turning of the steering masts and subsequent turning of the wheels.

The third object of the universal motorized scaffold truck is to provide motor driven mobility to the scaffold or "A" frame ladder, in which the battery powered motor turns at a high rate of speed through the worm gear that in turn delivers high torque, low speed rotation through the couplers to the axles which turn the drive wheels. In cases of light commercial usage a soft start C-flex module is placed between the motor and the worm gear to reduce the amount of torque while preserving the same load capabilities and low speed rotation. Other options on the drive assembly include alternating one of the two shaft couplers to a limited slip coupler or to a disc brake coupler so as to gain additional user control over the drive's dynamic braking system.

The fourth object of the universal motorized scaffold truck is to provide greater ease in controlling the directional movement of the scaffold or "A" frame ladder, in which the steering lever turns the steering masts through the female and male swivel ends that in turn rotates the steering plate that manipulates the draglink to push or pull the respective tie rods that are welded to the interior upright of a zero lead caster. Over-turning of the wheels is prevented by the wheel stops which are welded in place to the underside of the front upright support.

The final objective of the invention is to provide ease of transportation, in which the steering lever secures to the steering mast which telescopes downward from a height of approximately fourteen feet (when fully extended) to a height of just over six feet (standard height) then folds down by way of the male and female swivels. In addition, the relative light weight and compact construction allows the invention to be transported as easily as any piece of scaffold or "A" frame ladder without the use of ramps or transport trailers.

BRIEF DESCRIPTION OF THE DRAWINGS

The invention will be more fully understood by reference to the following detailed description in conjunction with the attached drawings wherein.

DETAILED DESCRIPTION OF THE DRAWINGS

Figure 3:
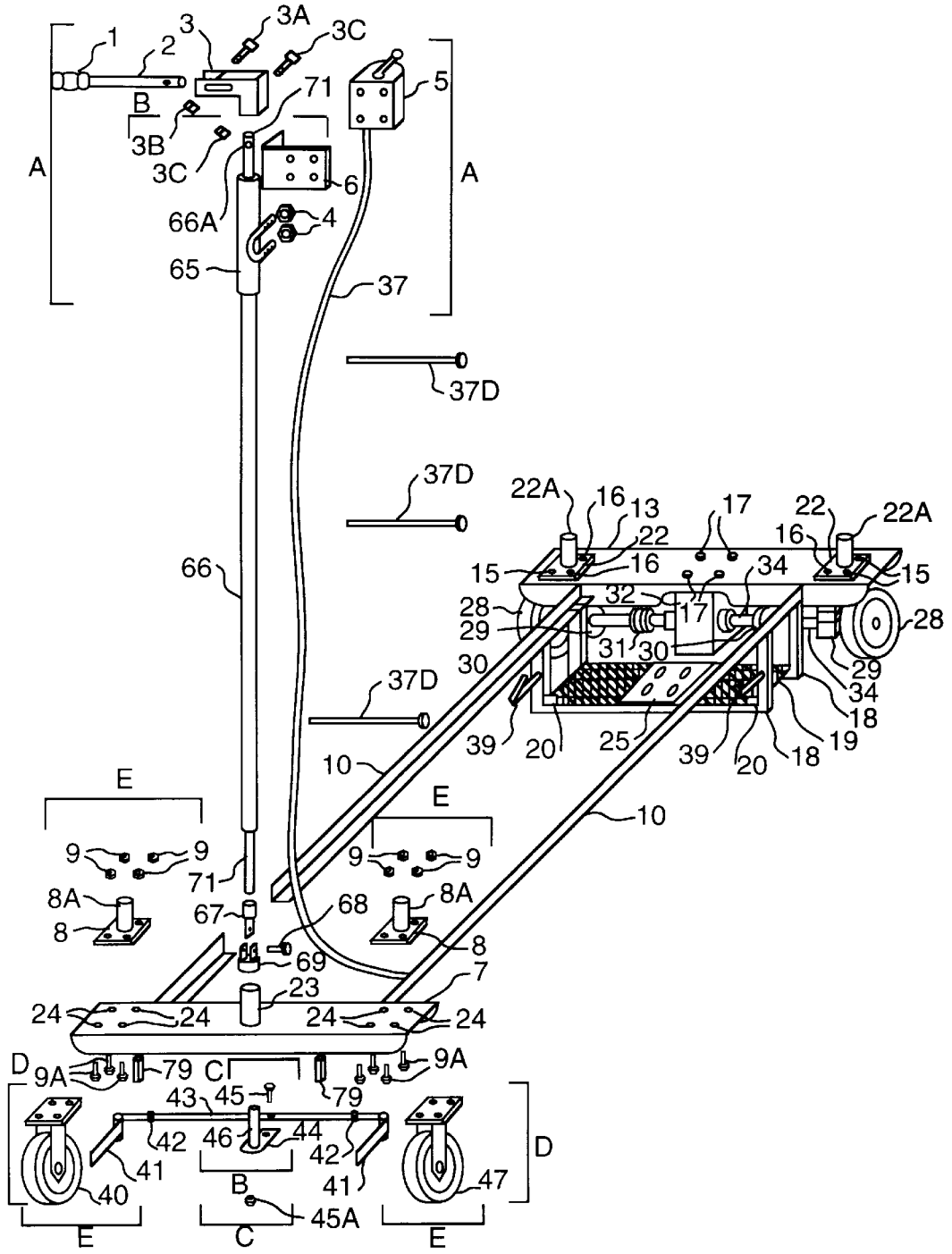
FIG. 3 Exploded Perspective View of invention showing complete steering assembly FIG. 4 Exploded Perspective View of invention showing complete drive assembly FIG. 5 Front Elevation thereof FIG. 6 Rear Elevation thereof FIG. 7 Right Side Elevation showing collapsed steering assembly FIG. 8 Exploded Perspective View of outrigger components

The universal motorized scaffold truck includes a rubber hand grip 1 that slides onto the end of the steering lever 2 which is connected to the steering head 3 by a bolt 3A and nut 3B that is in turn bolted at 3C through the outer steering mast 66 and inner steering mast 71 via hole 66A, just above the steering collar 65 that in turn supports the bottom edge of the steering head 3. The steering collar 65 is welded to the outer steering mast 66 and is where the U-bolts 4 (to secure the steering masts to the scaffold or ladder) and switch plate 6 are located and welded in place. On the switch plate 6 is a forward-off-reverse drum switch 5 that is secured to the plate by nuts 5A. The outer mast 66 houses the inner steering mast 71 which is connected to a male swivel end 67 that is connected by pin 68 to a female swivel end 69. The male swivel end 67 is large enough to support the outer mast 66 until extended upward, at which time the outer mast 66 is pinned 66A in place to the top of the inner mast 71 through the hole 66B that bolt 3C initially passed through. Bolt 3C remains in the steering head 3 when telescoped. The female swivel end 69 has a large base that rides on the top of the steering sleeve 23 which has been inserted through the front upright support 13 and then welded in place prior to steering placement. The female swivel end 69 is attached to the steering foot 46 (housed in the steering sleeve 23) that is welded to the steering plate 44. The steering plate 44 is connected by carriage bolt 45 and nut 45A to the drag link 43 to which nuts 42 have been welded at either end to secure the adjustable length tie rods 41. The width of the drag link 43 is adjusted by removing the internal bearing unit of the tie rod 41 and rotating the threaded end until the desired length is achieved. The flat strap end of the tie rods 41 are attached by welding to the interior uprights of the right and left zero lead casters 40 and 47. The right and left zero lead casters 40 and 47 are attached to the front upright support 7 means of bolts 9A that pass through the top plates on the right and left zero lead casters 40 and 47, through drilled and threaded (from below) holes 24 in the front upright support 7, then pass through the standard slotted front collar plate 8 (or the space saver slotted front collar plate 48) secured by nuts 9 to the front upright support 7. The front upright support 7 has welded to its underside two wheel stops 79, location of which is illustrated in FIG. 3, that prevent over steering. Also, welded to the rear lip of the front upright support 7 are two side support braces 10 and 10A.

The two side support braces have (near the rear of the frame) two slots but in each brace, 10 and 10A, for the insertion and subsequent welding in place of the carrier braces 18, and 18A. The carrier braces 18 and 18A, are composed of square structural tubing cut on a 45 degree angle and welded to form the drop, hold two battery trays 19 made of expanded melt spot welded in place, a standard slotted motor bearing plate 25 (or optional punched motor bearing plate 38) fillet welded in place, two battery stops 20 that are welded in the interior right angle bends of the steering end carrier brace 18A. Wire holders 39 are also located on the interior face of the steering end carrier brace 18A, the wire holder is positioned so that the short bent end is rotated 45 degrees towards the interior of the invention before being welded in place. The standard small frame battery cover 12 fits over the space created to house the motor 21 and batteries 36 by resting on the top lips of the side support braces 10, 10A, and on the top edge of the rear upright support 13, at which point the four pipe legs 74, welded to the underside of the battery cover, sleeve into the voids in the ends of the carrier braces 18, and 18A. The side support braces 10 and 10A continue on to be welded to the front facing lip of the rear upright support 13.

Figure 4:
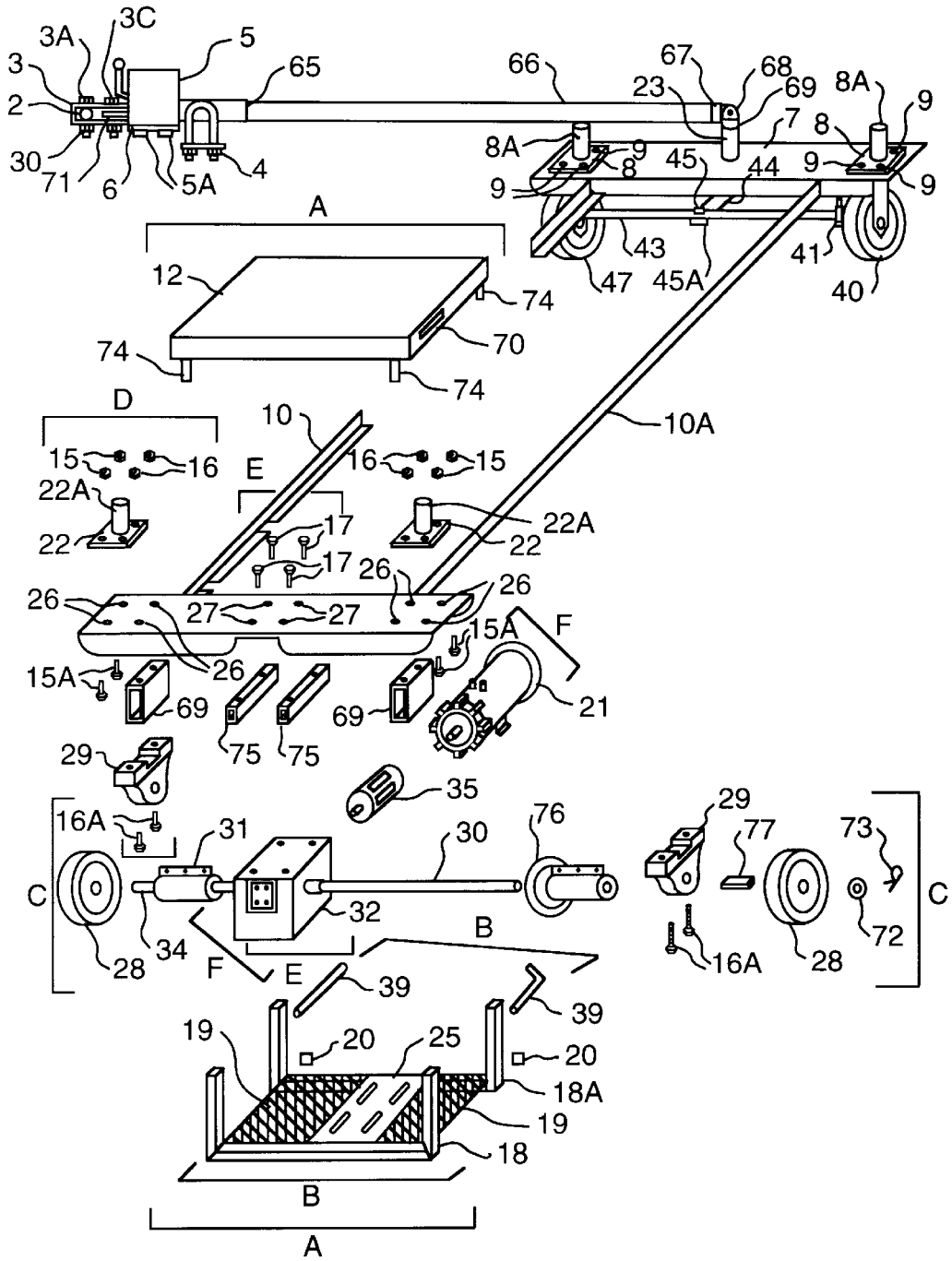

On the underside of the rear upright support 13 are two worm gear blocks 75 and two pillow block bearing blocks 69, which are welded in place, location is as shown in FIG. 4. The drive train, located below the rear upright support, is comprised of a direct current motor 21 powered by two 12 volt batteries 36; that are linked in series by a wire connector 37C that has two insulated wire connectors 37A that are attached to the batteries by thumb screws 37B. The motor 21 is first secured to the standard slotted motor bearing plate 25 (or to the optional punched motor bearing plate 38) by means of bolts 21A and nuts 21B, at this point the motor 21 can be either attached to the C-flex module 33 or directly connected to the worm gear 34. On the standard application model the motor 21 is connected directly to the worm gear 34. When in place the C-flex module 33 is placed directly between the motor 21 and the worm gear 32. The worm gear 32 has two right angle out-put shafts that are coupled to the right and left axles 30 and 34 respectively. The standard method includes two shaft type couplers 31 to connect the worm gear 32 out-puts to the right and left axles 30 and 34 respectively. Instead of the shaft type couplers 31 the right side coupler alone may be replaced by either a disc brake coupler 76 or a limited slip coupler 33, both of which reduce the initial torque from the worm gear 32 and decrease the length of the turning radius, but both eliminate the drive's positraction. From the shaft couplers 31 (disc brake coupler 76 or limited slip coupler 33) the right and left axles 30, 34 pass through the pillow block bearings 29 that are attached by bolts 16A to the pillow block bearing support 69 that is welded to the underside of the rear upright support 13. After passing through the pillow block bearings 29 the tapered keyed ends of axles 30 and 34 are inserted through the keyed drive tires 28. The drive tires are held in place by means of a key 77 that fits into the keyed openings in axles 30, 34, and the drive tire 28, set screws machined into the hub wall of the drive tires 28, and by a washer 72 that is set flush against the exterior face of the hub on the drive wheel 28 and cotter pinned 73 through a pilot hole drilled in the tapered end of the axles 30, 34. The two bolts 16A that hold the pillow block bearing 29 in place extend through drilled and threaded (from below) holes 26 in the rear upright support 13 through the standard slotted rear collar plate 22 (or the space saver slotted rear collar 49 or the offset slotted rear collar 14) and are secured by nuts 16. The other two bolts 15A necessary to secure the rear collar plates 22, 49, or 14 are also inserted from below, pass through drilled and threaded (from below) holes 26 in the rear upright support 13, then pass through the rear collar plates 22, 49, or 14 to be secured by nuts 15.

All of the slotted collar plates, standard front 8 or front space saver 48 and rear offset 14, standard rear 22, or rear space saver 29 have welded at specific places on the plate, as indicated by FIGS. 1G through 1L and FIGS. 2G through 2L, structural steel tube collars 8A, 48A for the front respectively and 14A, 22A, 49A for the rear respectively. The collars provide limited adjustability to within three to five inches, so for differences in scaffold or ladder widths that are greater than six inches the overall width of the truck can be reduced as small as twenty inches or as wide as six and one-half feet. For differences in length, the overall length of the side braces can be shortened to eighteen inches or extended to ten feet. The scaffold or ladder is attached to the truck by way of the collars that the ends of the scaffold or ladder can sleeve into.

Figure 1A:
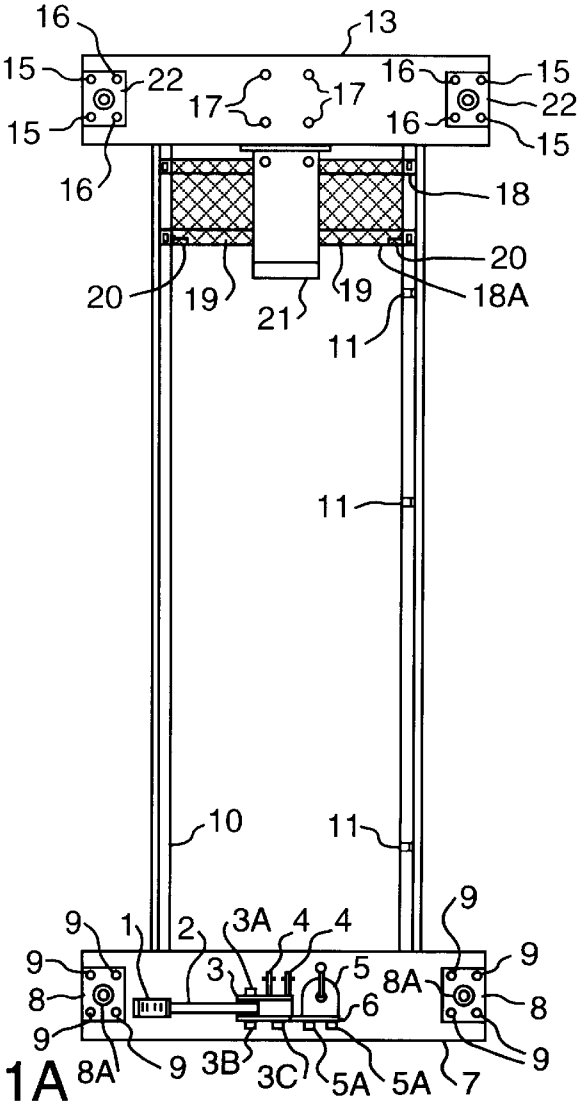
FIG. 1A Plan View of the invention without battery cover
Figure 1:
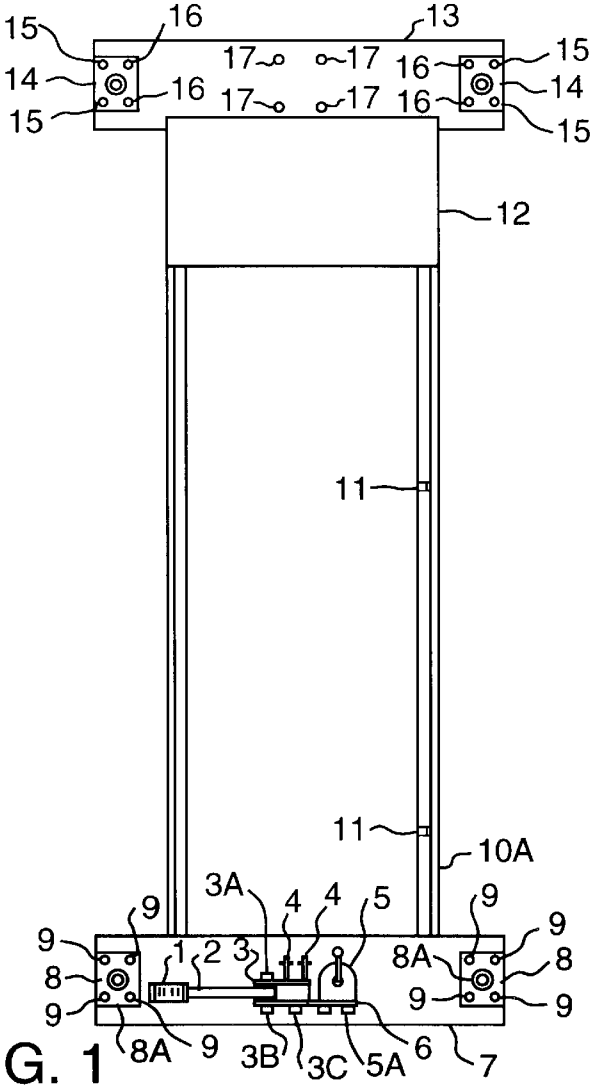
FIG. 1 Plan View of the Universal Motorized Scaffold Truck with battery cover in place.

FIG. 1 is a Plan View illustration of the invention complete with standard small frame battery cover 12 in place. The standard small frame battery cover 12 is constructed of plate steel that is cut, bent, and welded to form a box top with four sides equal in length which is used on frames up to forty inches in width. Also shown, extending to the left (or right in case of alternate side driver request) is the rubber hand grip 1 that slides over the steering lever 2 that fits into and is connected to the steering head 3 by means of a bolt 3A and nut 3B, which is then secured to the outer steering mast 66 (and when not telescoped to full operating height, the inner steering mast 71) by means of a nut and bolt 3C. The steering head 3 rests on the top of the steering collar 65 which is welded to the top of the outer steering mast 66. The switch box plate 6, made of plate steel bent to fit around the steering collar 65 prior to welding to the steering collar 65, extends to either the right or to the left of the outer steering mast 66 (sides alternate to account for driver request of right or left hand steering) holds the forward-off-reverse drum switch 5 that is secured by nuts 5A. Located on the steering collar 65, below the switch plate 6 are the two U-bolts 4, one per side welded in place with legs extended towards the rear of the invention, that secure the steering assembly to the top of the scaffold or ladder structure. As this is an over head view, the steering collar 65, outer mast 66, inner mast 71, and other related parts cannot be seen, thus, their complete documentation is provided in the detailed description for FIG. 3. The front upright support brace 7, is shown with the standard slotted front collars 8, 8A secured in place by nuts 9 and bolts 9A. Please note that all of the collars are comprised of two parts welded together, a steel plate and a section of structural steel tube, therefore all collars from this point on will have both corresponding part numbers listed to illustrate the final product of a single component. Extending from the rear facing lip of the front upright support 7 are two side support braces 10 and 10A, made of steel angle, on which side support brace 10A holds the wire clips 11 that keep the main control line 37 in place. Resting on the top lip of the side support braces 10, 10A and the top of the rear upright support 13, is the standard small frame battery cover 12 as it appears with legs 74 sleeved into the carrier braces 18 and 18A (not shown here). The rear upright support 13 has welded to its front facing lip the other end of the side support braces 10 and 10A (actual connection not illustrated here). Shown on the rear upright support are the offset slotted rear collar 14, 14A as secured in place by nuts 15, 16 and bolts 15A and 16A. The exterior, nut and bolt assembly 15, 15A is the same size but differs in length from interior nut and bolt assembly 16, 16A. Also shown are the bolts 17 used to secure the worm gear 32 to the worm gear blocks 75 welded to the underside of the rear upright support 13.

FIG. 1A is essentially identical to FIG. 1 except that the standard small frame battery cover 12 has been removed to show the carrier braces 18 and 18A, and the placement of the motor 21 on the carrier assembly. Both carrier braces 18 and 18A sleeve through precut notches in the side support braces 10 and 10A then are welded in place. The square tube steel carrier braces 18 and 18A hold the battery trays 19, standard slotted motor bearing plate 25 (or the optional punched motor bearing plate 38), battery stops 20, and wire holders 39 (which cannot be seen from this angle but are shown in FIG. 3). The battery trays 19, made of expanded metal, are located on either side of the standard slotted motor bearing plate 25 (or optional punched motor bearing plate 38). Not shown, for greater ease of understanding, are the batteries 36 that are included in FIG. 1C. The battery stops 20 are small flat steel squares that are welded in the interior corners of the steering end carrier brace 18A. The battery stops 20 keep the batteries 36 from sliding off of the battery trays 19.

Figure 1C:
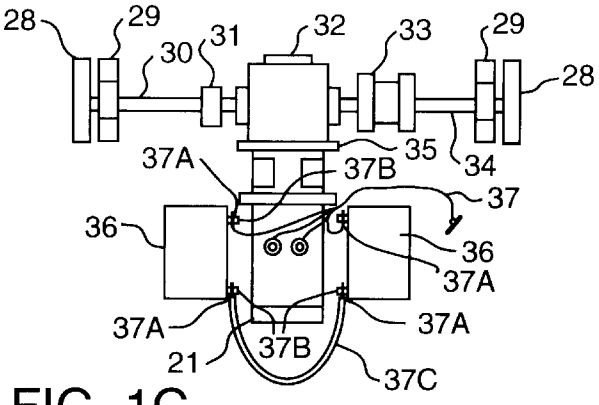
FIG. 1C Plan View of the drive train and batteries
Figure 1D:
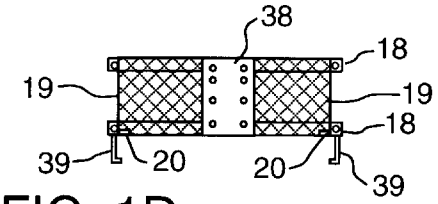
FIG. 1D Plan View of the sub-frame assembly
Figure 1E:
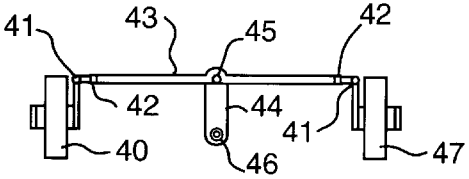
FIG. 1E Plan View of steering sub-assembly
Figure 1B:
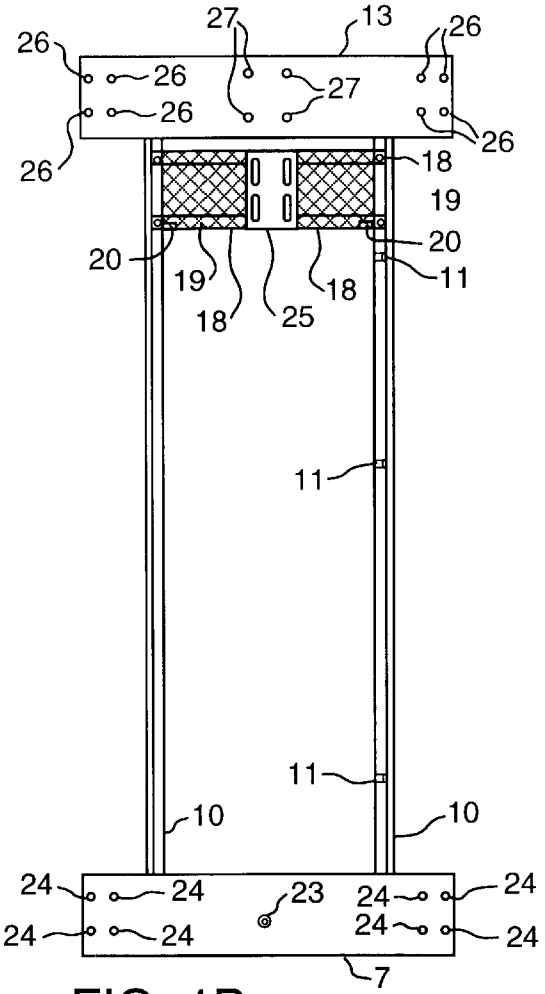
FIG. 1B Plan View of the invention, frame only

FIG. 1B shows the invention without the steering assembly so as to show the steering sleeve 23 placement in the front upright support 7. Also, on the front upright support 7, the standard slotted front collars 8, 8A and bolts 9A have been eliminated to show the drilled and threaded (from below) holes 24 that allow collar placement and type to be changed while holding the steering sub-assembly in place. This works by threading and subsequently inserting the bolts from below, so that when the nuts 9 are removed the threads prevent the bolts 9A from dropping free and disengaging the steering sub-assembly (shown in FIG. 1E). The motor 21 has been removed to allow the standard slotted motor bearing plate 25 to be viewed. The standard slotted motor bearing plate 25 has been slotted to account for the difference in distances generated with the ommittance or inclusion of the C-flex module 35, the optional punched motor bearing plate 38 provides punched holes for securing only the motor 21. On the rear upright support 13 the offset slotted rear collars 14, 14A have been removed to show the drilled and threaded (from below) holes 26. These holes 26 serve the same purpose as the ones on the front of the invention, save that only the pillow block bearings 29 need to be held securely in place during collar movement. Shown also are the smooth bore holes 27 that allow bolt 17 penetration from the top of the rear upright support 13 through the worm gear blocks 75 to the top of the worm gear 32.

FIG. 1C shows in plan view the entire drive train with the optional limited slip coupler 33 in place (the other optional disc brake coupler 76 is shown in FIG. 4), the optional C-flex module 35, the batteries 36, and the wiring assembly 37 A through D. The direct current motor 21 is powered by the two batteries 36 linked in series by the battery connector wire 37C that has two insulated wire connectors 37A that are attached by thumb screws 37B to the posts on the batteries 36. The batteries 36 are connected to the motor 21 and forward-off-reverse drum switch 5 by way of the main connector line 37 which also has four insulated wire connectors 37A and two thumb screws 37B. The main connector line 37 is installed as shown then wraps around the wire wraps 39, continues along the side rail support brace 10A and is held in place by wire clips 11, then ascends the outer steering mast 66 while being secured by plastic ties 37D, and finally terminates in the base of the forward-off-reverse drum switch 5 (shown in FIGS. 3and 4). The motor 21 is connected to the C-flex module 35 which is connected to the worm gear 32. The worm gear 32 has two right angle out-put shafts that are coupled to the axles 30 and 34. Following the right side out-put, the worm gear 32 attaches to right axle 30 with a standard shaft coupler 31, from there the right axle 30 passes through the pillow block bearing 29 and through the machined hub of the drive wheel 28. The end of right axle 30 is tapered and keyed as is the hub on the drive wheel 28. The axle is secured by a key 77 that fits in the two keyed openings, and by set screws machined into the hub of drive wheel 28. Following the left side axle out-put, the worm gear 32 attaches to left axle 34 with a limited slip coupler 33, then the left axle 34 passes through pillow block bearing 29 and the hub of drive wheel 28, in a manner identical to the right side.

FIG. 1D is the plan view of the sub-frame assembly alone. This was done in order to better show the placement of wire wraps 39, battery stops 20, and the placement of the optional punched motor bearing plate 38.

FIG. 1E is the plan view of the steering sub-assembly. The steering foot 46 (which is housed in the steering sleeve 23) is welded to the steering plate 44 which is connected to the draglink 43 by a carriage bolt 45 and nut 45A. From there, the draglink has welded to the ends nuts 42; for the purpose of adjusting the linkage; that thread to the threaded rot end of the tie rods 41. The tie rods 41 have flat end plates that are welded to the front upright support of the right and left zero lead casters 40 and 47. The top plates of the right and left zero lead casters 40 and 47 have been ommitted in order to show the welded connection between the tie rod 41 and the right and left zero lead casters 40 and 47.

Figure 1F:
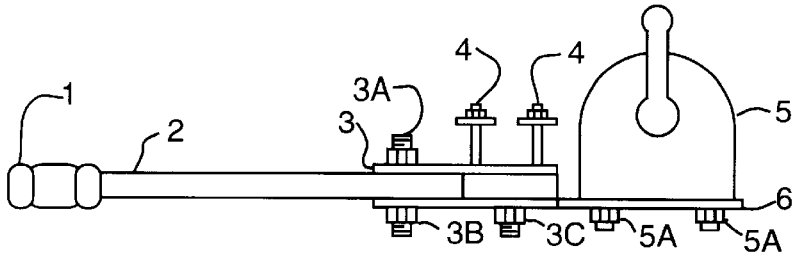
FIG. 1F Enlarged Plan View of steering head assembly

FIG. 1F is an enlarged plan view of the top of the steering for greater viewing ability of the aforementioned parts.

Figure 1G:
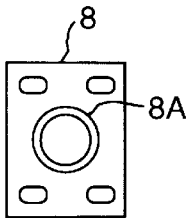
FIG. 1G Enlarged Plan VIew of standard slotted front collar

FIG. 1G is an enlarged plan view of standard slotted front steering plate 8 and welded on collar 8A. This assembly places the collar 8A centrally over the drive wheel 28 and coupler 31 rather than directly over the drive wheel 28.

Figure 1H:
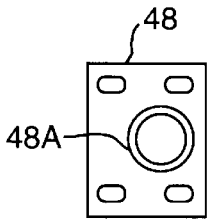
FIG. 1H Enlarged Plan View of space saver slotted front collar

FIG. 1H is an enlarged plan view of space saver slotted front steering plate 48, and welded on collar 48A. This particular collar is used when shortening frame width is a priority. This assembly places the collar directly over the drive wheel 28.

Figure 1J:
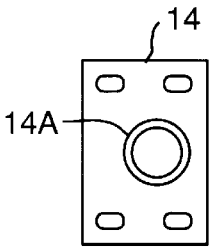
FIG. 1J Enlarged Plan View of offset slotted rear collar

FIG. 1J is an enlarged plan view of the offset slotted rear collar 14 plate and welded on collar 14A. This particular collar is used when the rear width of the structure varies from the front width, as some manufactured ladders vary the front and rear widths. This assembly also places the collar 14A centrally over the drive wheel 28 and coupler 31.

Figure 1K:
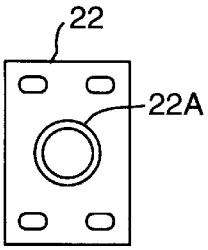
FIG. 1K Enlarged Plan View of standard slotted rear collar

FIG. 1K is an enlarged plan view of the standard slotted rear plate 22 and welded on collar 22A. This particular collar is used in conjunction with the corresponding standard slotted front collar 8,8A.

Figure 1L:
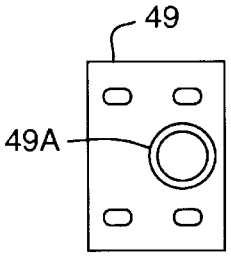
FIG. 1L Enlarged Plan View of space saver slotted rear collar

FIG. 1L is an enlarged plan view of the space saver slotted rear plate 22 and welded on collar 22A. The space saver collars are situated on the frames so that the collar side sits on the outer edge of the upright supports, placing the weight over the drive wheels 28.

Figure 1M:
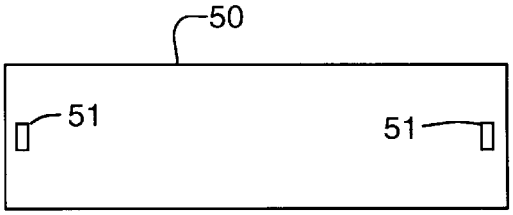
FIG. 1M Plan View of small frame battery cover with optional handle placement FIG. 1N Plan View of large frame battery cover FIG. 1P Plan View of invention showing heavy duty use outriggers FIG. 2 Left Side Elevation of invention as shown in FIG. 1

FIG. 1M is an enlarged plan view of a typical midsized battery cover 50 that can range in size from thirty inches to forty eight inches. The handles 51 are placed on the top rather than having the sides slotted 70, as is on the standard small frame battery cover 12.

Figure 1N:
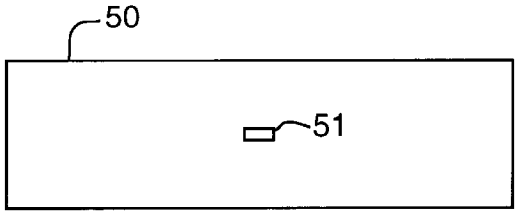

FIG. 1N is an enlarged plan view of a typical large battery cover 50A that can range in size from forty eight inches to seventh seven inches. The handle 51 is placed on top in a central position for greater ease of removal.

Figure 1P:
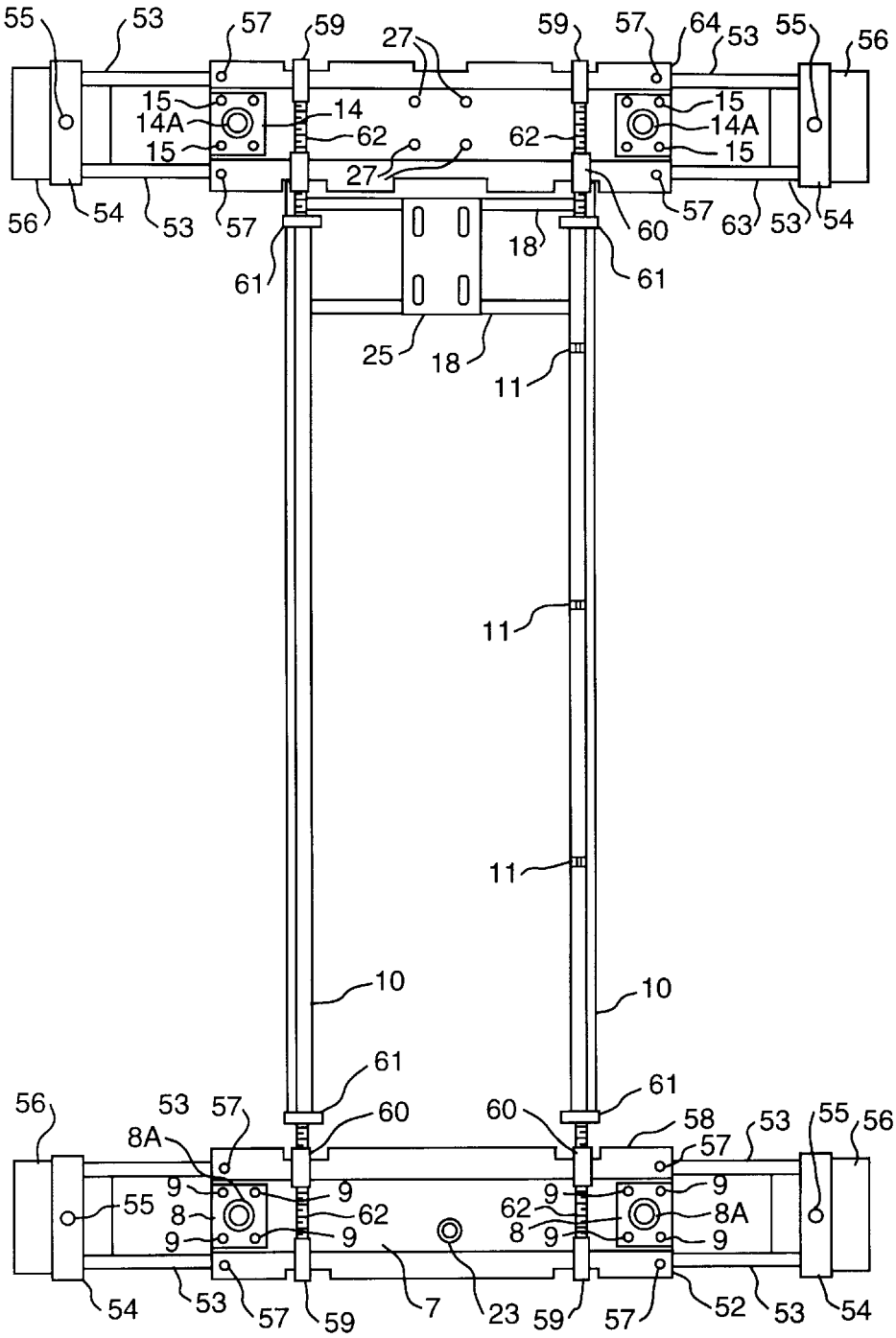
Figure 8:
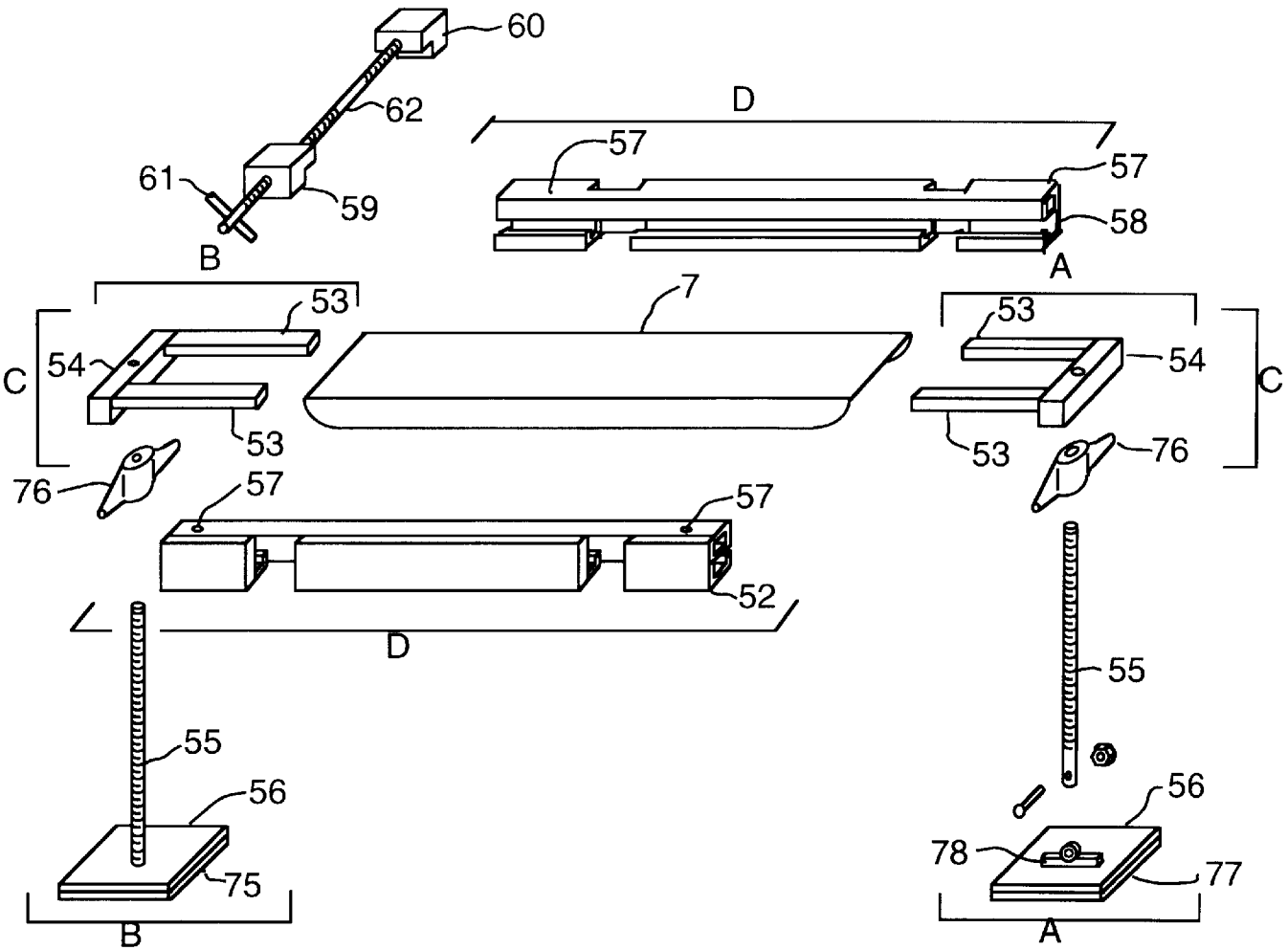

FIG. 1P is a plan view of the invention showing the optional heavy duty outrigger assembly. Outriggers are not necessary for the invention and are considered options only. The front outrigger assembly is comprised of front steering brace 52, extension arms 53, block supports 54, threaded lift rod 55, rubber tracked bearing plate 56, sleeve bolt 57, rear steering brace 58, end blocks 59, start blocks 60, clamp handle 61, and opposing threaded rod 62. The front assembly is attached by taking the front and rear steering braces 52 and 58 respectively, placing their hooked bottoms under the lips of the front upright support 7 and securing with the clamp assembly. The clamp assembly works by placing the end blocks 59 in the notched areas, tightening the start blocks 60 in the corresponding notches by turning clamp handle 61 which turns the opposing threaded rod 62. The extension arms 53 sleeve in the ends of the front and rear steering braces 52 and 58, and are welded to the block supports 54. In the center of the block supports 54 is a threaded lift rod 55 that supports a lift handle (shown in FIG. 8). The threaded lift rod is welded to or pinned—to either a rubber tracked bearing plate 56 (interior use) or to a steel cleated bearing plate—, these options are illustrated in FIG. 8. The rear outrigger assembly is comprised of front drive brace 63, extension arms 53, block supports 54, threaded lift rod 55, rubber tracked bearing plate 56, sleeve bolt 57, rear drive brace 64, end blocks 59, start blocks 60, clamp handle 61, and opposing threaded rod 62. The rear assembly is attached by taking the front and rear drive braces, 63 and 64 respectively, placing their hooked bottoms under the lips of the rear upright support 13 and securing with the clamp assembly. The clamp assembly works by placing the end blocks 59 in the notched areas, tightening the start blocks 60 in the corresponding notches by turning clamp handle 61 which turns the opposing threaded rod 62. The extension arms 53 sleeve in the ends of the front end and rear drive braces 63 and 63, and are welded to the block supports 54. In the center of the block supports 54 is a threaded lift rod 55 that supports a lift handle (shown in FIG. 8). The threaded lift rod is welded to or planned—to either a rubber tracked bearing plate 56 (interior use) or to a steel cleated bearing plate—, these options are illustrated in FIG. 8.

Figure 2:
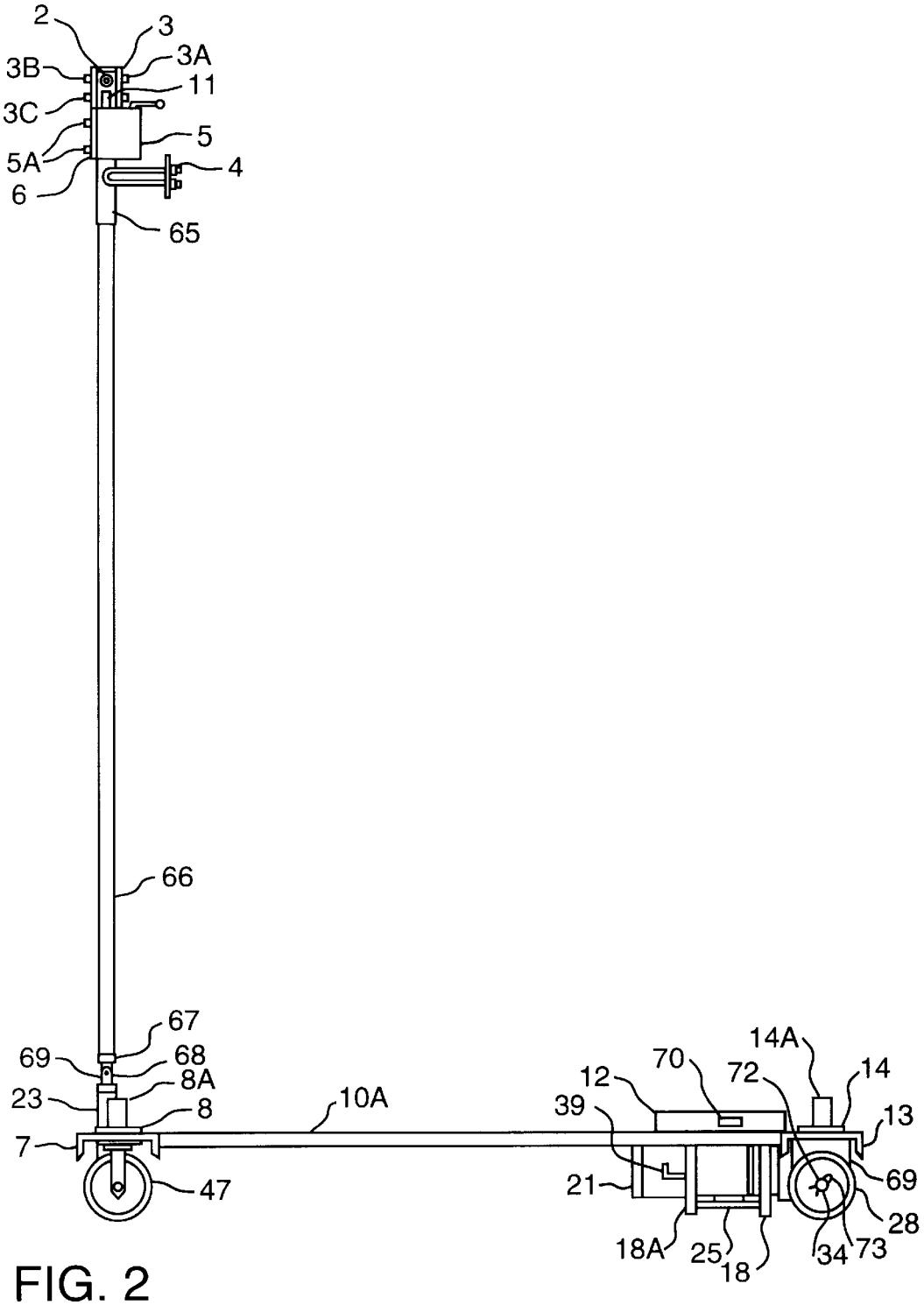
FIG. 2A Left Side Elevation of invention as shown in FIG. 1A
FIG. 2B Left Side Elevation of invention as shown in FIG. 1B
FIG. 2F Enlarged Left Side Elevation of steering head assembly as shown in FIG. 1F
FIG. 2G Enlarged Left Side Elevation of standard slotted front collar as shown in FIG. 1G
FIG. 2H Enlarged Left Side Elevation of spacer saver slotted front collar as shown in FIG. 1H
FIG. 2J Enlarged Left Side Elevation of offset slotted rear collar as shown in FIG. 1J
FIG. 2K Enlarged Left Side Elevation of standard slotted rear collar as shown in FIG. 1K
FIG. 2L Enlarged Left Side Elevation of space saver slotted rear collar as shown in FIG. 1L
FIG. 2M Left Side Elevation of battery cover as shown in FIG. 1M
FIG. 2N Left Side Elevation of battery cover as shown in FIG. 1N
FIG. 2P Left Side Elevation of invention as shown in FIG. 1P

FIG. 2 is a left side elevation of the invention at standard steering height. Shown are the steering lever 2 as is connected to the steering head 3 by bolt 3A and nut 3B. The steering head 3 is connected by bolt 3C to the outer and inner steering masts 66 and 71. The steering collar 65 welded to the outer steering mast 66 and supports the switch box plate 6 and U-bolts 4. The outer steering mast 66 rides on the male swivel end 67 which is connected by pin 68 to the female swivel end 69 which rides on the steering sleeve 23. The front upright support 7 is shown with standard slotted front collar 8,8A and left zero lead caster 47 secured in place. The side support brace 10A is shown with the attached carrier braces 18 and 18A to which is attached the wire wraps 39 and standard slotted motor bearing plate. The standard small frame battery cover 12 with hand hold slots 70 is located over the carrier braces 18 and 18A. The rear upright support 13 is shown with offset slotted rear collar 14, 14A, and pillow block bearing block in place. Also shown is the drive wheel 28 with left axle 34 held in place with washer 72 and cotter pin 73.

Figure 2A:
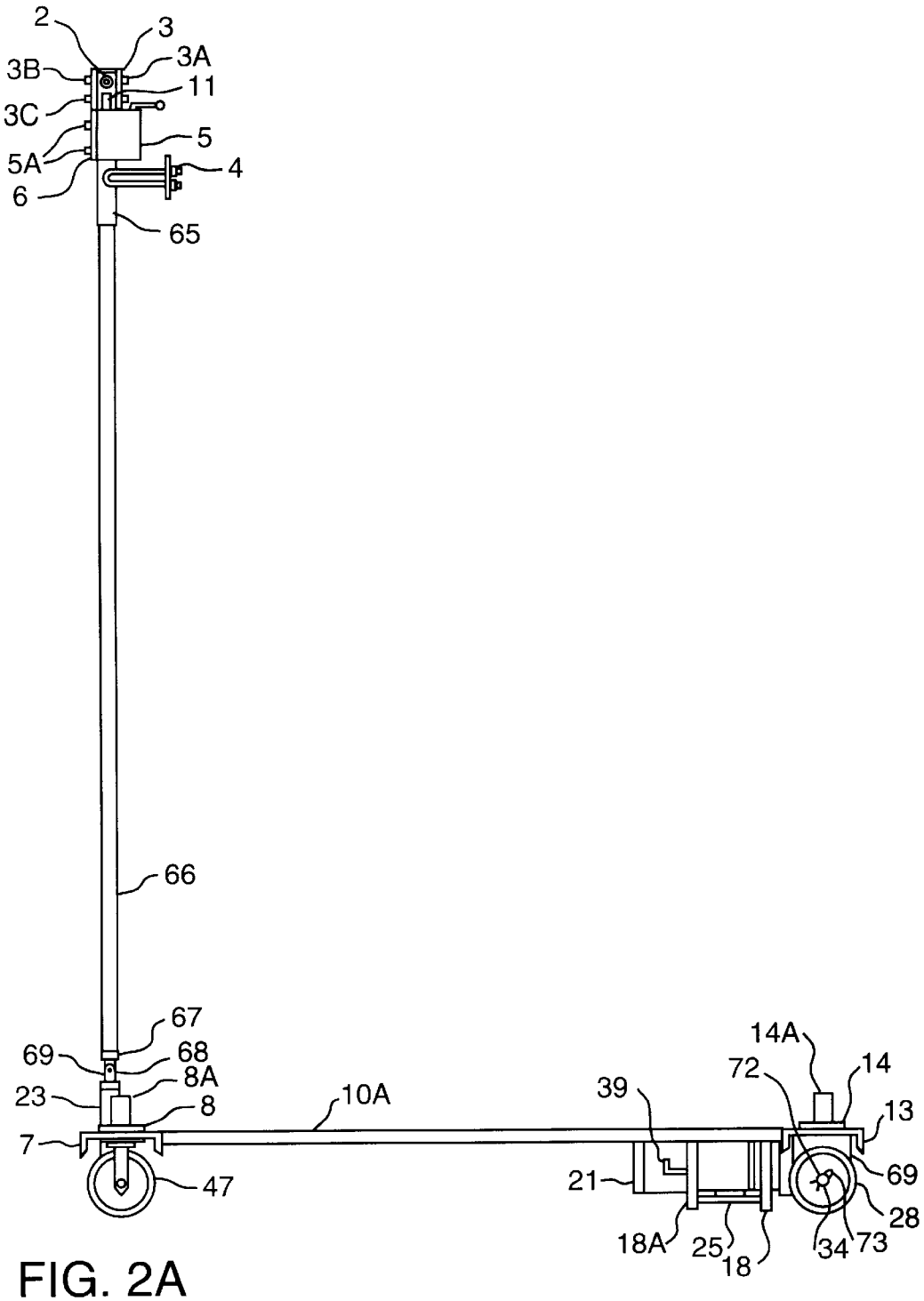

FIG. 2A is essentially identical to FIG. 2 the only difference is that the standard small frame battery cover has been removed.

Figure 2B:
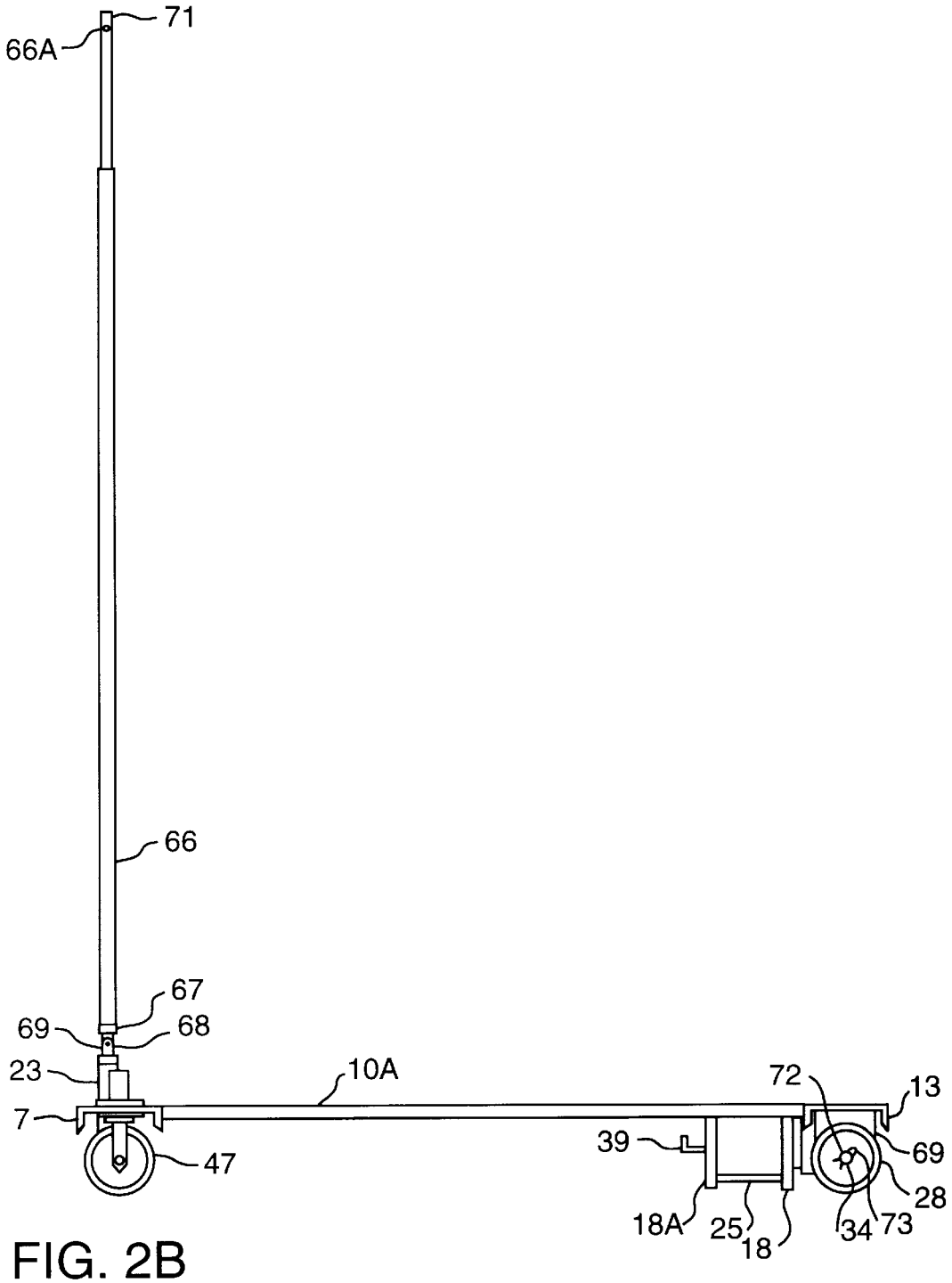

FIG. 2B is a left elevation of the invention with the steering head 3 and steering collar 65 removed. The outer steering mast has been reduced in height to show the inner mast 71 with hole 66A for the pin—to be placed when telescoping the outer mast 66. The standard slotted front collars have been removed to allow the side view of the steering sleeve with female and male swivel ends 67 and 69.

Figure 2F:
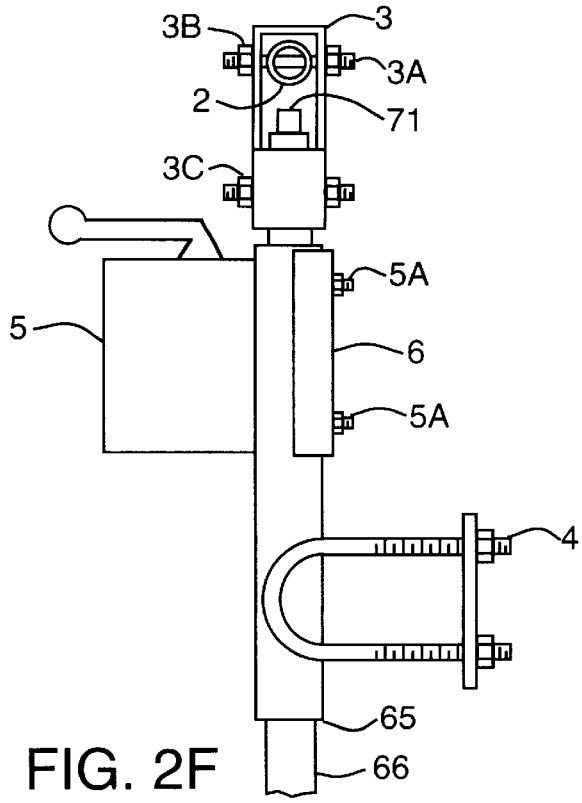
Figure 2G:
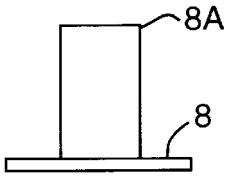
Figure 2H:
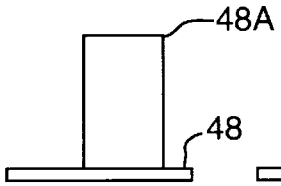
Figure 2J:
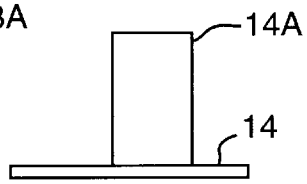
Figure 2K:
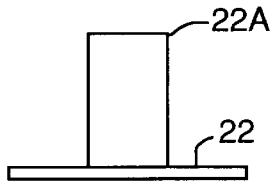
Figure 2L:
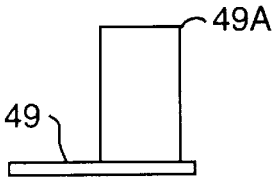

FIG. 2F is an enlarged left elevation of the steering head 3 and steering collar 65 with all the associated parts enlarged for a clearer view.

FIGS. 2G through 2L are enlarged left side elevations of the collars.

Figure 2M:
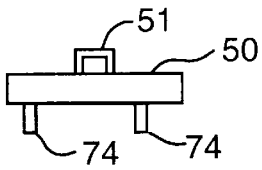

FIG. 2M is an elevation of the midsized battery cover 50 showing carrier braces 18 and 18A.

Figure 2N:
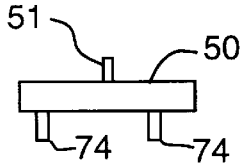

FIG. 2N is an elevation of the large frame battery cover 50A showing the single handle 51 and legs 74.

Figure 2P:
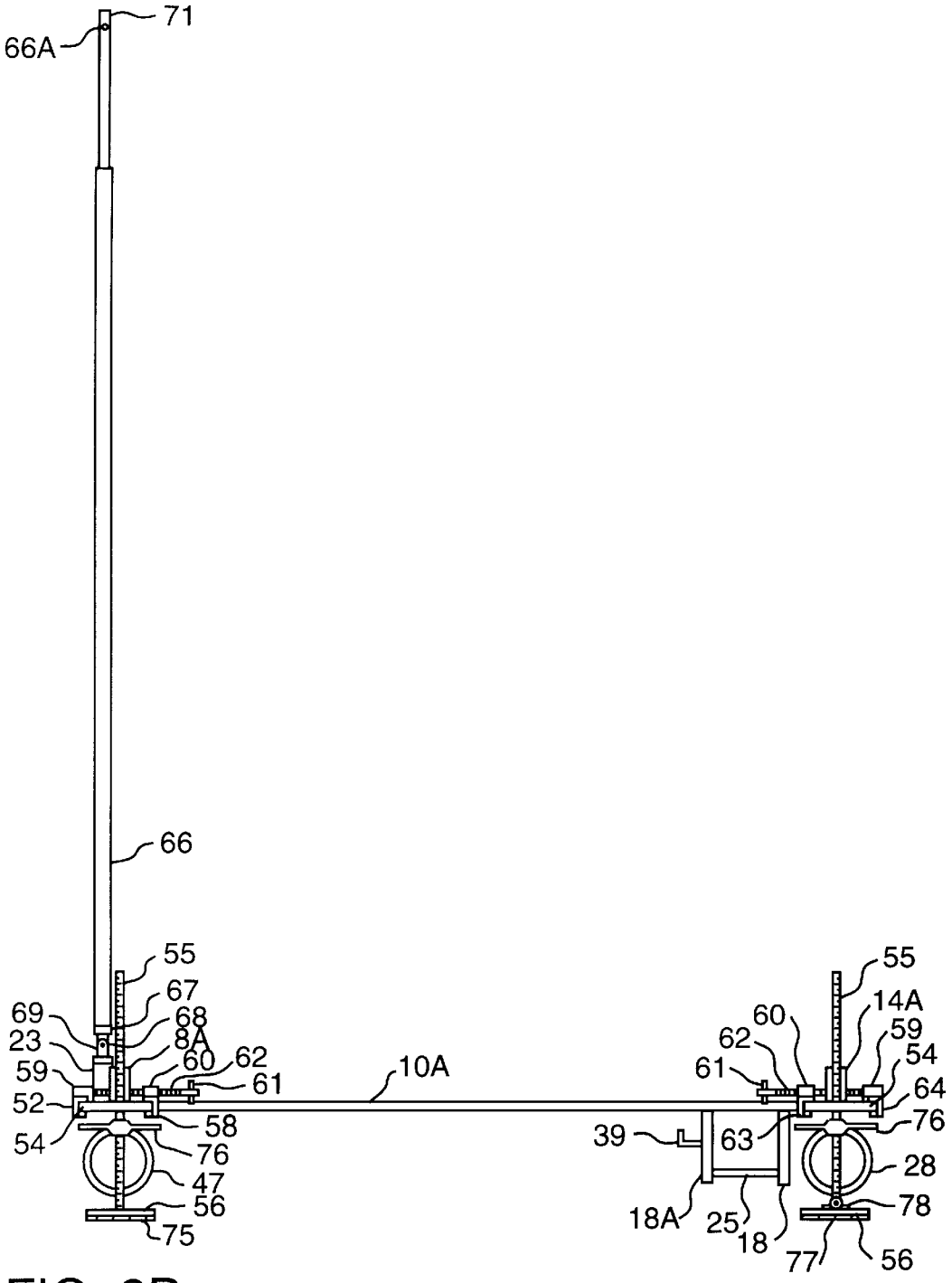

FIG. 2P is a left side elevation of the invention with outriggers attached. This better illustrates the total support afforded to the front and rear upright supports 7 and 13 as supplied by the front and rear steering and drive braces 52 and 58, 63 and 64 respectively. Also shown are the lift handles 76, bearing plate 56 with rubber backing 77, bearing plate 56 with steel cleated bottom 75. The invention is lifted by removing sleeve bolt 57, pulling the block support 54 out to the desired distance, replacing the sleeve bolt 57, and turning the lift handle 76 against the block support 54 until the threaded rod 55 has extended downward far enough that the bearing plate 56 pushes against the ground. Tightening of the braces is achieved by rotating the clamp handle 61. When the clamp handle 61 is turned the opposing threaded rod 62 pulls the end blocks 60 and start blocks 59 together or pushes them apart due to the user of opposing threaded. The braces are notched so as not to interfere with the side support braces 10 and 10A. Plus, notches in the braces occur where the rear upright support 13 is copied to allow access to the worm gear 32 and motor 21.

FIG. 3 is a perspective view of the invention with the steering assembly exploded. Bracket A illustrates the slotted steering head 3 that allows the steering lever 2 when bolted with bolt 3A and nut 3B to be extended, rotated about the bolted connection until parallel with the outer steering mast 66 which disallows turning of the steering assembly. The switch box plate 6 is shown as it is bent for placement on the steering collar 65. The forward-off-reverse drum switch 5 is shown with the main connecting line 37 installed. Bracket B shows how the outer mast 66 houses the inner mast 71 which is attached to the male swivel end 67. The male swivel end 67 is connected by pin 68 to the female swivel end 69. The female swivel end 69 rides on but is not connected to the steering sleeve 23, rather the female swivel end 69 is connected to the steering foot 46. The steering foot is shown as welded to the steering plate 44. Bracket C shows the connection of carriage bolt 45 to drag link 43 to steering plate 44 to nut 45A. Bracket D shows how the right and left zero lead casters 40 and 47 are connected to the flat plates of the tie rods 41. Then shown is how the threaded rod end of the tie rods 41 threaded into nuts 42 that are welded to the drag link 43. Brackets E illustrate how the bolts 9A come up through the plates on the right and left zero lead casters 40 and 47, to the front upright support 7, through the threaded from below holes 24, to penetrate the slots of the standard slotted front plate 8. To which is attached collar 8A and nuts 9A. Also shown are the wheel stops 79 that are welded to the underside of the front upright support 7.

FIG. 4 is a perspective view of the invention with the steering folded, and the drive end in exploded view. Bracket A shos how the carrier braces 18 and 18A come up through the notches in the side support braces 10 and 10A, to which the standard small frame size battery cover 12 lowers to sleeve legs 74 into the voids in the tube steel. Bracket B shows how the battery stops 20 and wire wraps 39 are placed on the steering and carrier bracket 18A. Bracket C is a lateral breakdown of the drive from the cotter pin 73 to the washer 72 to the drive wheel 28 that connects with key 77 in line with the opening in the pillow block bearing 29 and the opening in the disc brake coupler 76 that connects axle 30 to the out-put on the worm gear 32 which is connected to standard shaft coupler 31 and shows drive wheel 28 as the end connection. Bracket D illustrates how the pillow block bearing 29 is bolted 16A through the pillow block bearing support block 69 (that is welded to the underside of the rear upright support 13) and how bolts 15A pass through the threaded from below holes 26 in the rear upright support 13, through the standard sloted rear plate 22. To which is connected to collar 22A and nuts 16 and 15. Bracket E shows how the bolts 17 pass through the rear upright support 13 via smooth bore holes 27, through the worm gear support blocks 75, to thread into the top of the worm gear 32. Bracket F shows how the worm gear 32, C-flex module 35, and motor are connected.

Figure 5:
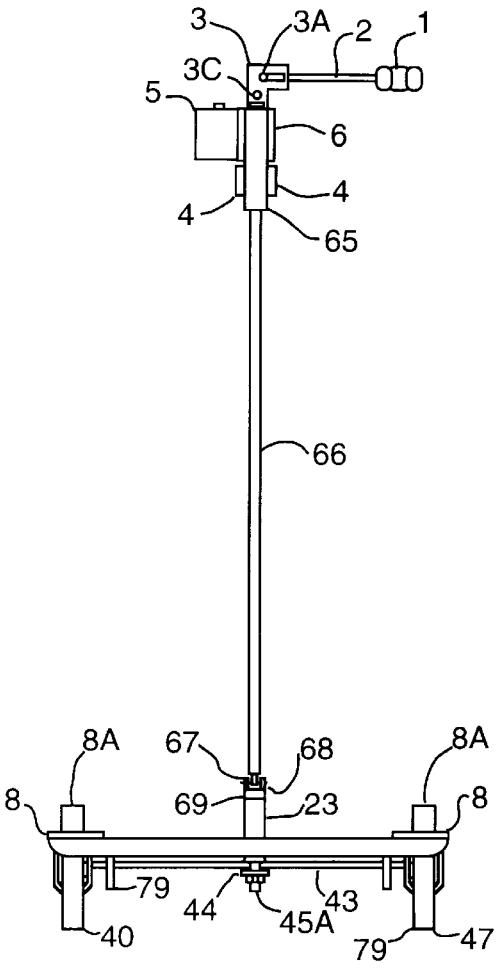

FIG. 5 is a front elevation view of the entire invention.

Figure 6:
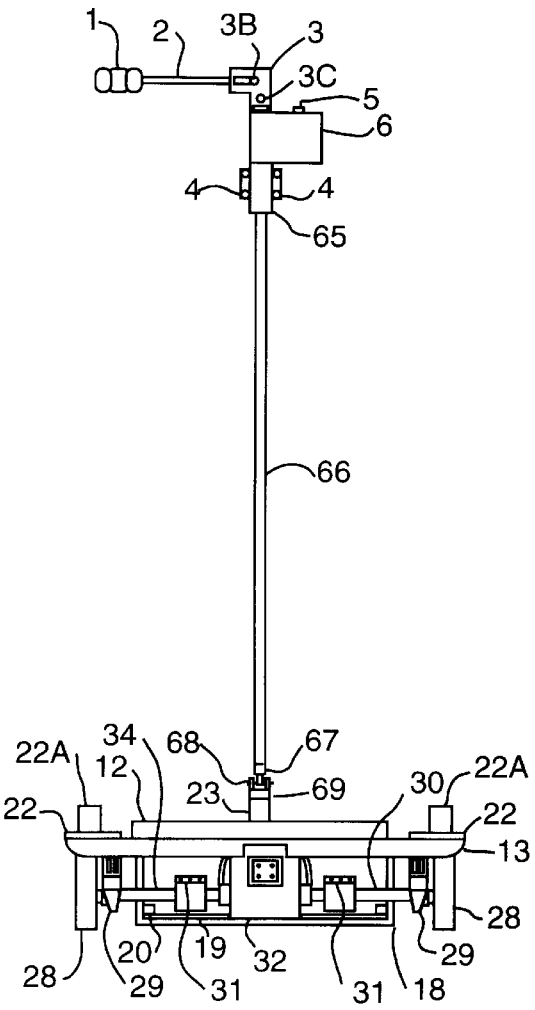

FIG. 6 is a rear elevation view of the complete invention showing usage of two standard shaft couplers 31.

Figure 7:
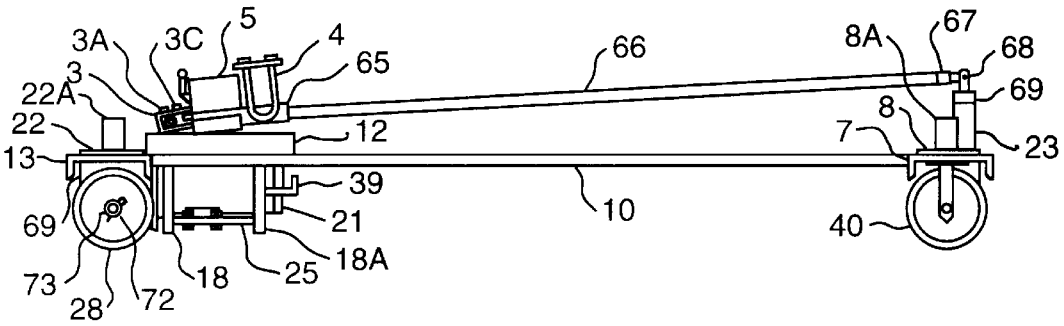

FIG. 7 is a right elevation view of the invention without the C-flex module 35, showing the steering assembly laying down for transport.

FIG. 8 is a partial exploded view of the front outrigger assembly. Bracket A shows how the rubber, backer 77 bearing plate 56 with pinned connection 78 to the threaded rod 55 passes through the lift handle 76 and through the support block 54. Bracket B shows how the steel cleated 75 bearing plate 56 is welded to the threaded rod 55 that passes through the lift handle 76 and through the support block 54. Bracket C illustrates how the support block 54 is welded to the extension arms 53 that are in line with the top of the front upright support 7. Bracket D illustrates how the front steering brace 52 and rear steering brace 58 are notches to fit on the front upright support 7 while supporting its bottom lips.

While there is shown and described a present embodiment of the invention, it is to be understood the invention is not limited thereto, but may be otherwise variously embodied and practised within the scope of the following claims.

I claim:

1. A universal motorized scaffold truck comprising:

a horizontal support frame comprising front and rear support plates interconnected by two side support braces, said support plated each having mounting apertures at their respective ends, said support frame supported by four wheels spaced in a rectangular arrangement for lateral movement on a ground surface;

a vertical extendable steering mast having upper and lower ends and secured at said lower end to said front support plate and having a steering mechanism connected for steering selected of said wheels from the upper end of said mast;

an electric motor mounted on said frame and engaged for driving selected of said wheels;

a switch at the upper end of said mast for selectively energizing said electric motor; and four upwardly open collars respectively positioned in horizontally spaced relationship on said front and rear support plates adjacent said wheels and dimensioned for respectively receiving and retaining bottom leg ends of a scaffold for thereby fully supporting the entire weight of a scaffold on said support platform, selected of said collars rigidly fixed to respectively underlying mounting plates which plates are in turn removably mounted on said front and rear support plates, said underlying mounting plates having slotted apertures and being secured to the support plates by fasteners extending through respective mounting and slotted apertures for securement of said underlying mounting plates at different predetermined positions on said support frame for thereby providing adjustable horizontal spacing between collars whereby standard scaffold of varied size may be entirely supported on said frame in said collars.

2. The universal scaffold truck of claim 1 including a battery supported by said frame and connected for energization of said electric motor through said switch.

3. The universal scaffold truck of claim 1 including a disc brake coupler disposed between said motor and said wheels.

4. The universal scaffold truck of claim 1 including a limited slip coupler disposed between said motor and said wheels.

5. The universal motorized scaffold truck of claim 1 wherein said steering mast having means for horizontal fold-down storage on said frame.

6. The universal motorized scaffold truck of claim 1 including a locking mechanism adapted for locking said steering mast in its vertical position.

7. The universal motorized scaffold truck of claim 6 wherein said vertically extendable steering mast telescopically extends.

8. The universal motorized scaffold truck of claim 1 including fastener means for releasably securing said steering mast to said scaffold means.

9. The universal motorized scaffold truck of claim 1 including outwardly extendable out riggers secured to said frame and having adjustable floor bearing plates for stabilizing and leveling said frame.

10. The universal motorized scaffold truck of claim 1 including soft start means engaged with said motor for providing gradual start-up drive of said driven wheels.

* * * * *